US007137218B1

(12) United States Patent
Adkins, Jr.

(10) Patent No.: US 7,137,218 B1
(45) Date of Patent: Nov. 21, 2006

(54) MUZZLE LOAD ASSEMBLY

(76) Inventor: Wayne L. Adkins, Jr., 4836 Richmond Rd., Warrensville Heights, OH (US) 44128

( * ) Notice: Subject to any disclaimer, the term of this patent is extended or adjusted under 35 U.S.C. 154(b) by 0 days.

(21) Appl. No.: 11/234,803

(22) Filed: Sep. 26, 2005

(51) Int. Cl.
*F41C 7/00* (2006.01)

(52) U.S. Cl. ..... 42/51; 102/522

(58) Field of Classification Search ..... 42/51; 102/522; 224/931; 89/34
See application file for complete search history.

(56) References Cited

U.S. PATENT DOCUMENTS

| | | | | |
|---|---|---|---|---|
| 2,566,569 | A * | 9/1951 | Jensen | 224/239 |
| 3,577,921 | A | 5/1971 | Van Langenhoven | |
| 4,194,657 | A * | 3/1980 | Thor | 224/667 |
| 4,757,894 | A * | 7/1988 | Schreckenstein | 206/3 |
| 4,759,885 | A | 7/1988 | Kurtz | |
| D298,348 | S | 11/1988 | Posey | |
| 5,152,442 | A * | 10/1992 | Gallagher | 224/245 |
| 5,269,224 | A * | 12/1993 | Gonzales et al. | 102/288 |
| 5,415,102 | A * | 5/1995 | White | 102/522 |
| 5,726,378 | A | 3/1998 | Barrett | |
| 6,085,454 | A * | 7/2000 | Caudle | 42/90 |
| 6,523,475 | B1 | 2/2003 | Smalley, Jr. et al. | |
| 6,688,232 | B1 | 2/2004 | Griesbach et al. | |
| 2004/0182274 | A1 * | 9/2004 | Bond | 102/520 |

* cited by examiner

*Primary Examiner*—Michael J. Carone
*Assistant Examiner*—Gabriel J. Klein

(57) ABSTRACT

A muzzle load assembly includes a flexible sleeve that has a first end, a second end and a peripheral wall extending between the first and second ends. The first end is open. A bullet is positioned within the sleeve. A plurality of powder charges is attached to the second end of the sleeve and extends away from the second end of the sleeve in an aligned orientation with respect to each other. Each of the power charges comprises a fibrous casing having gunpowder therein. The sleeve, bullet and attached powder charges are extendable into a muzzle of a muzzle-loading rifle.

6 Claims, 3 Drawing Sheets

MUZZLE LOAD ASSEMBLY

BACKGROUND OF THE INVENTION

1. Field of the Invention

The present invention relates to gun load devices and more particularly pertains to a new gun load device for loading a muzzle loading rifle in an efficient and expedited manner.

2. Description of the Prior Art

The use of gun load devices is known in the prior art. U.S. Pat. No. 5,726,378 describes a device propellant charge for a muzzle loading firearm. Another type of gun load device is U.S. Pat. No. 3,577,921 comprising a case-less ammunition construction for a firearm. A consumable black power cartridge is found in U.S. Pat. No. 4,759,885. Another black powder receiving cartridge is depicted in U.S. Pat. Des. No. 298,348.

While these devices fulfill their respective, particular objectives and requirements, the need remains for a device that includes one or more powder charges and a bullet positioned attached together in a unitary configuration and which can be loaded into a muzzle loading rifle. The unitary configuration allows for quicker loading of the rifle than if the bullet and power chargers were loaded independently of each other. The device should also include a sealed housing for holding a plurality of the bullets and attached powder charges. The housing will prevent moisture from affecting or compromising the integrity of the powder charges.

SUMMARY OF THE INVENTION

The present invention meets the needs presented above by generally comprising a flexible sleeve that has a first end, a second end and a peripheral wall extending between the first and second ends. The first end is open. A bullet is positioned within the sleeve. A plurality of powder charges is attached to the second end of the sleeve and extends away from the second end of the sleeve in an aligned orientation with respect to each other. Each of the power charges comprises a fibrous casing having gunpowder therein. The sleeve, bullet and attached powder charges are extendable into a muzzle of a muzzle-loading rifle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
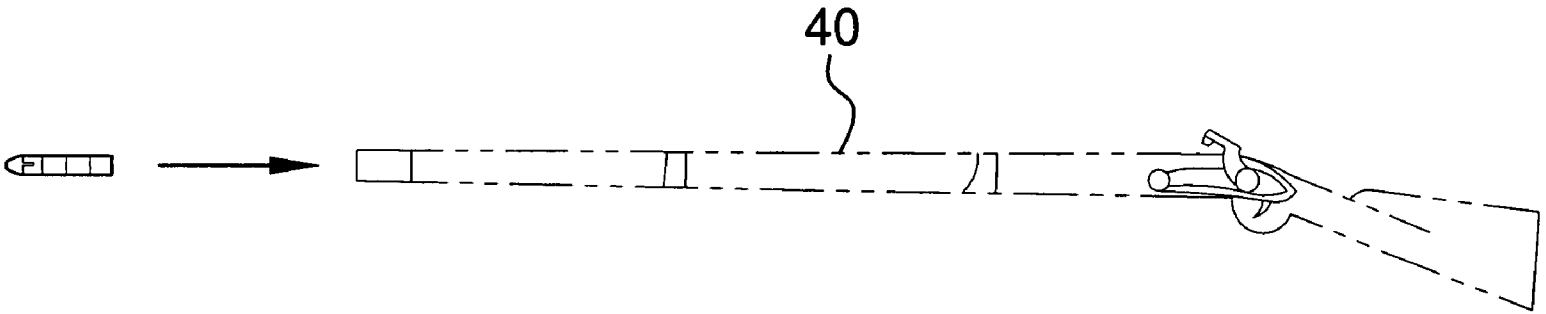
FIG. 1 is a side in-use view of a muzzle load assembly according to the present invention.
Figure 2:
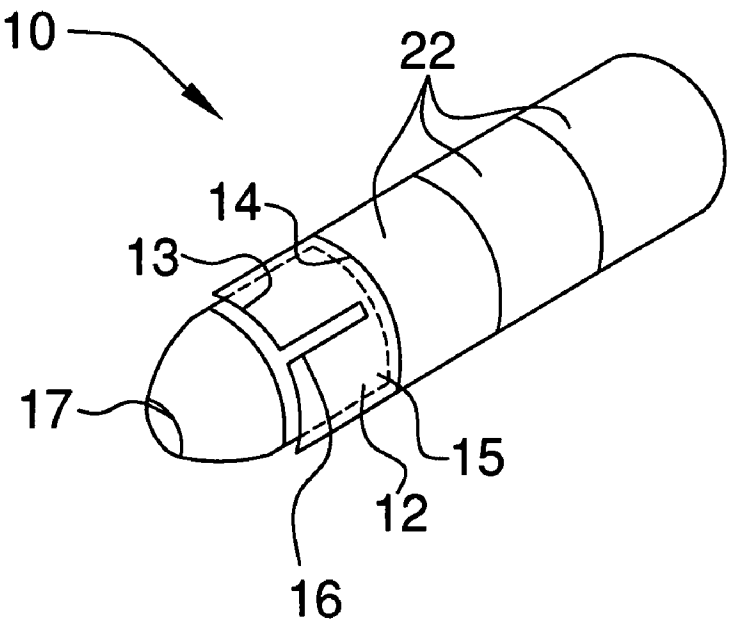
FIG. 2 is a perspective view of the present invention.
Figure 3:
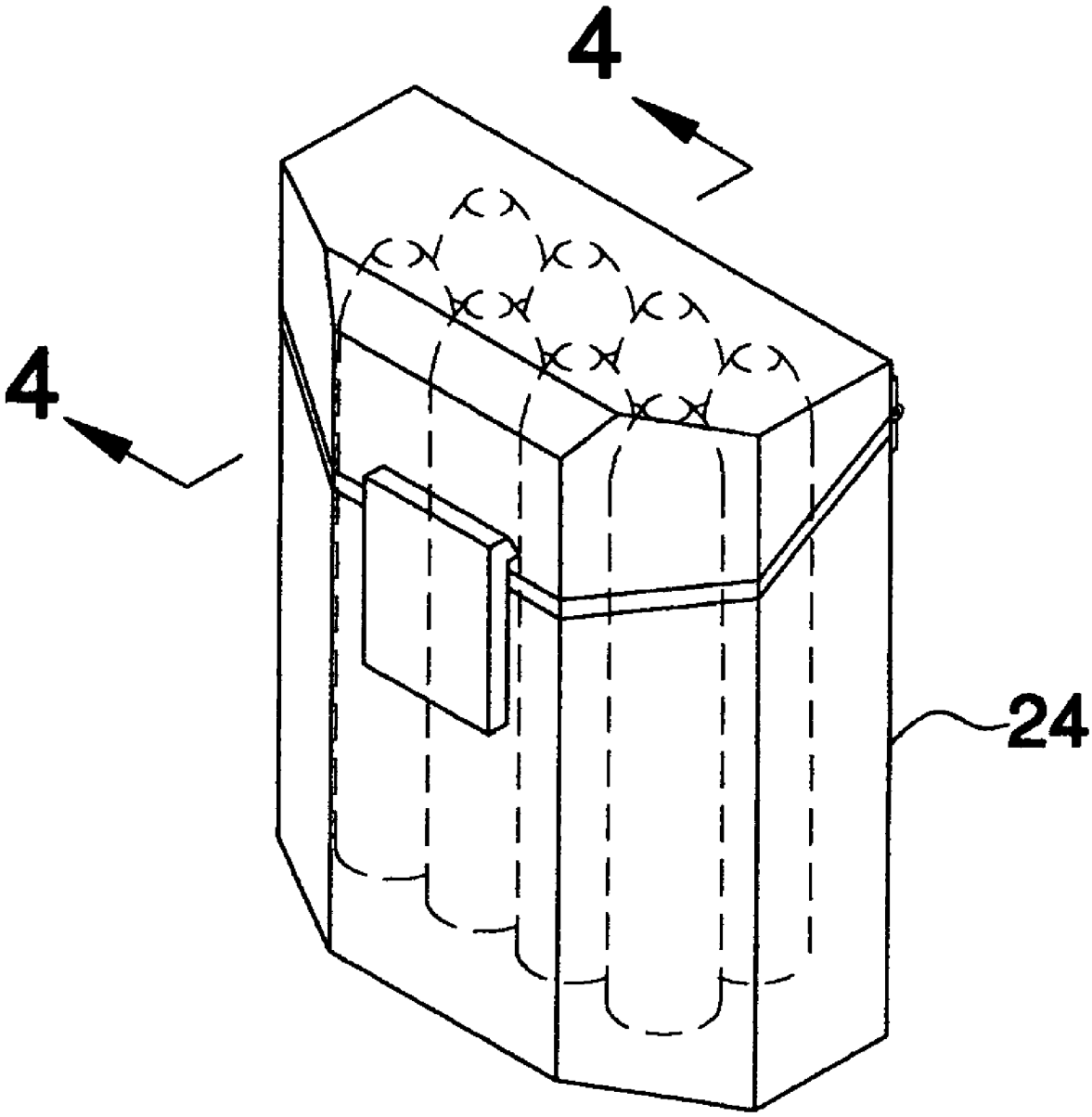
FIG. 3 is a perspective view of the housing of the present invention.
Figure 4:
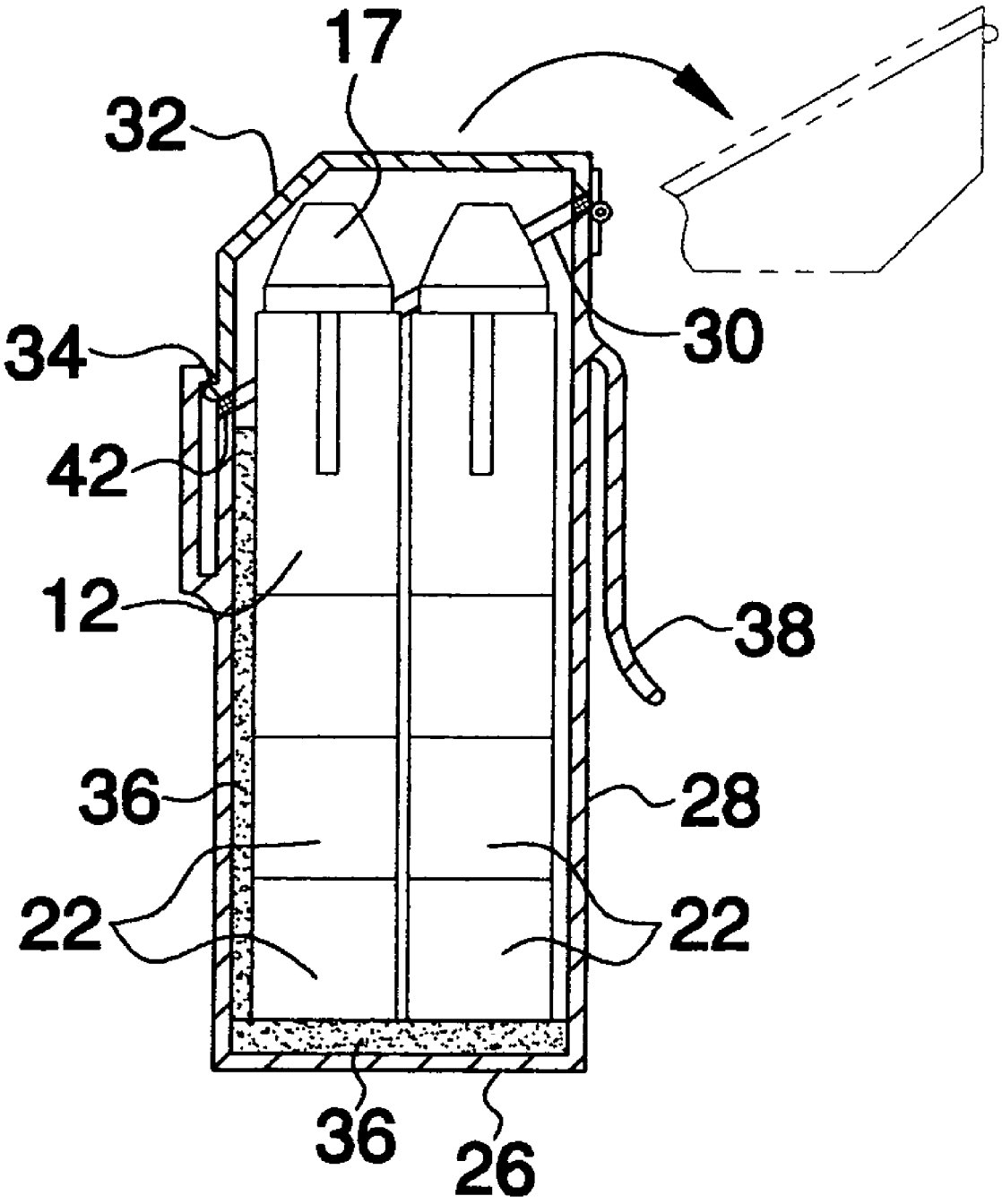
FIG. 4 is a cross-sectional view taken along line 4—4 of FIG. 3 of the present invention.

With reference now to the drawings, and in particular to FIGS. 1 through 4 thereof, a new gun load device embodying the principles and concepts of the present invention and generally designated by the reference numeral 10 will be described.

As best illustrated in FIGS. 1 through 4, the muzzle load assembly 10 generally comprises a flexible sleeve 12 that has a first end 13, a second end 14 and a peripheral wall 15 extending between the first 13 and second ends 14. The first end 13 is open. The sleeve 12 is preferably comprised of a plastic material and has slits 16 therein extending into the first end 13 to allow the sleeve 12 to receive a bullet 17 and to open up once a gun holding the sleeve 12 has been fired. A bullet 17 is positioned within the sleeve 12. At least one, and preferably a plurality of powder charges 22 is attached to the second end 14 of the sleeve 12 and extends away from the second end 14 of the sleeve 12 in an aligned orientation with respect to each other. Each of the power charges 22 is comprised of a fibrous casing having gunpowder therein. The fibrous casing is preferable a paper housing.

A housing 24 has a bottom wall 26 and a peripheral wall 28 that is attached to the bottom wall 26. The peripheral wall 28 has an upper edge 30 that defines an opening extending into the housing 24. The sleeve 12 and attached powder charges 22 is positionable within the housing 24. A cover 32 is attached to the upper edge 30 and is selectively positionable in a closed position covering the opening or in an open position exposing the opening. A securing member 34 is mounted on the housing 24 and is configured to releasably secure the cover 32 in the closed position. A resiliently compressible material 36 is positioned on and covers an inner surface of the bottom 26 and peripheral 28 walls. A belt clip 38 is attached to an outer surface of the peripheral wall 28.

In use, the sleeve 12, bullet 17 and attached powder charges is extendable into a muzzle of a muzzle-loading rifle 40. The sleeve 12 already contains the power charge 22 and bullet 20 thus allows skips the dual steps of positioning a bullet as well as a power charge into the rifle 40. This will increase the speed of loading the rifle 40. The housing 24 is used for holding a plurality of the assembly 10 each containing a bullet 20 and at least one powder charge 22. A seal 42 is positioned between the housing 24 and the cover 32 to ensure that the housing 24 may be closed in a watertight manner. The belt clip 38 allows a person to attach the housing 12 to their belt. This will increase the ease of use of the assembly 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A muzzle load device comprising:

a flexible sleeve having a first end, a second end and a peripheral wall extending between said first and second ends, said first end being open;

a bullet being positioned within said sleeve, a plurality of powder charges being attached to said second end of said sleeve and extending away from said second end of said sleeve in an aligned orientation with respect to each other, each of said powder charges comprising a fibrous casing having gunpowder therein;

a housing having a bottom wall and a peripheral wall being attached to said bottom wall, said peripheral wall having an upper edge defining an opening extending into said housing, said sleeve and attached ones of said powder charges positionable within said housing, a cover being attached to said upper edge and being selectively positionable in a closed position covering said opening or in an open position exposing said opening;

a resiliently compressible material being positioned on and covering an inner surface of said bottom and peripheral walls; and wherein said sleeve, bullet and powder charges are extendable into a muzzle of a muzzle loading rifle.

2. The device according to claim 1, wherein said fibrous casing is comprised of a paper material.

3. The device according to claim 1, further including a securing member being mounted on said housing and being configured to releasably secure said cover in said closed position.

4. The device according to claim 1, further including a belt clip being attached to an outer surface of said peripheral wall.

5. The device according to claim 3, further including a belt clip being attached to an outer surface of said peripheral wall.

6. A muzzle load device comprising:

a flexible sleeve having a first end, a second end and a peripheral wall extending between said first and second ends, first end being open;

a bullet being positioned within said sleeve, a plurality of powder charges being attached to said second end of said sleeve and extending away from said second end of said sleeve in an aligned orientation with respect to each other, each of said powder charges comprising a fibrous casing having gunpowder therein;

a housing having a bottom wall and a peripheral wall being attached to said bottom wall, said peripheral wall having an upper edge defining an opening extending into said housing, said sleeve and attached ones of said powder charges being positionable within said housing, a cover being attached to said upper edge and being selectively positionable in a closed position covering said opening or in an open position exposing said opening, a securing member being mounted on said housing and being configured to releasably secure said cover in said closed position;

a resiliently compressible material being positioned on and covering an inner surface of said bottom and peripheral walls;

a belt clip being attached to an outer surface of said peripheral wall; and wherein said sleeve, bullet and powder charges are extendable into a muzzle of a muzzle loading rifle.

* * * * *